US010151223B2

(12) United States Patent
McConville

(10) Patent No.: US 10,151,223 B2
(45) Date of Patent: Dec. 11, 2018

(54) VALVE DEACTIVATING SYSTEM FOR AN ENGINE

(71) Applicant: Ford Global Technologies, LLC, Dearborn, MI (US)

(72) Inventor: Gregory Patrick McConville, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 149 days.

(21) Appl. No.: 15/429,989

(22) Filed: Feb. 10, 2017

(65) Prior Publication Data

US 2017/0356314 A1 Dec. 14, 2017

Related U.S. Application Data

(60) Provisional application No. 62/347,870, filed on Jun. 9, 2016.

(51) Int. Cl.

| | |
|---|---|
| ***F01L 1/053*** | (2006.01) |
| ***F01L 13/00*** | (2006.01) |
| ***F01L 1/047*** | (2006.01) |
| *F01M 9/10* | (2006.01) |
| *F01L 1/46* | (2006.01) |
| *F02D 13/02* | (2006.01) |
| *F02D 13/06* | (2006.01) |

(52) U.S. Cl.

CPC ..... *F01L 13/0005* (2013.01); *F01L 1/047* (2013.01); *F01L 1/46* (2013.01); *F01L 2001/0476* (2013.01); *F01L 2001/0535* (2013.01); *F01L 2013/001* (2013.01); *F01M 9/102* (2013.01); *F01M 9/105* (2013.01); *F02D 13/0203* (2013.01); *F02D 13/06* (2013.01)

(58) Field of Classification Search

CPC ..... F01L 2001/0476; F01L 2001/0535; F01L 1/46; F01L 13/0005; F01M 9/102; F01M 9/105

USPC ..... 123/90.12, 90.15, 90.17, 90.27, 90.34

See application file for complete search history.

(56) References Cited

U.S. PATENT DOCUMENTS

| | | | | |
|---|---|---|---|---|
| 3,958,541 A * | 5/1976 | Lachnit | F01M 9/102 | 123/90.34 |
| 4,199,202 A * | 4/1980 | Maeda | F01L 1/04 | 123/196 R |
| 4,258,673 A * | 3/1981 | Stoody, Jr. | F01M 9/102 | 123/90.34 |
| 5,351,661 A | 10/1994 | Doll | | |

(Continued)

OTHER PUBLICATIONS

Glugla, Chris Paul, "System and Method for Reactivating Engine Cylinders," U.S. Appl. No. 15/428,353, filed Feb. 9, 2017, 188 pages.

(Continued)

*Primary Examiner* — Jorge Leon, Jr.

(74) *Attorney, Agent, or Firm* — Julia Voutyras; McCoy Russell LLP

(57) ABSTRACT

Systems and methods for operating an engine with deactivating valves are presented. In one example, a groove in a camshaft controls oil flow to a valve operator that selectively activates and deactivates a poppet valve of a cylinder. The groove moves with the camshaft so that oil delivery to the valve operator is timed properly to deactivate and reactivate the cylinder.

13 Claims, 5 Drawing Sheets

(56) References Cited

U.S. PATENT DOCUMENTS

| | | | | |
|---|---|---|---|---|
| 5,785,026 | A * | 7/1998 | Moriya | F01L 1/34406 123/90.17 |
| 5,803,040 | A | 9/1998 | Biesinger et al. | |
| 6,332,446 | B1 | 12/2001 | Matsumoto et al. | |
| 7,363,892 | B2 * | 4/2008 | Fujii | F01L 1/18 123/90.15 |
| 7,819,096 | B2 | 10/2010 | McConville et al. | |
| 8,245,692 | B2 | 8/2012 | Glugla et al. | |
| 8,727,943 | B2 | 5/2014 | Surnilla et al. | |
| 8,800,515 | B1 | 8/2014 | Smith | |
| 9,120,478 | B2 | 9/2015 | Carlson et al. | |
| 9,175,613 | B2 | 11/2015 | Parsels et al. | |
| 9,249,748 | B2 | 2/2016 | Verner | |
| 9,506,411 | B2 | 11/2016 | Glugla et al. | |
| 2011/0030657 | A1 | 2/2011 | Tripathi et al. | |
| 2012/0143471 | A1 | 6/2012 | Tripathi et al. | |
| 2012/0221217 | A1 | 8/2012 | Sujan et al. | |
| 2013/0092127 | A1 | 4/2013 | Pirjaberi et al. | |
| 2013/0092128 | A1 | 4/2013 | Pirjaberi et al. | |
| 2014/0041625 | A1 | 2/2014 | Pirjaberi et al. | |
| 2014/0350823 | A1 | 11/2014 | Glugla | |
| 2015/0308301 | A1 | 10/2015 | McConville et al. | |
| 2015/0367830 | A1 | 12/2015 | Soliman et al. | |
| 2016/0115884 | A1 | 4/2016 | VanDerWege et al. | |
| 2016/0222899 | A1 | 8/2016 | Glugla | |
| 2016/0290182 | A1 * | 10/2016 | Musha | F01L 1/053 |
| 2017/0284241 | A1 * | 10/2017 | Kataoka | F01L 1/022 |

OTHER PUBLICATIONS

Glugla, Chris Paul, "System and Method for Controlling Engine Knock," U.S. Appl. No. 15/428,376, filed Feb. 9, 2017, 189 pages.

Glugla, Chris Paul, "System and Method for Controlling Engine Knock of a Variable Displacement Engine," U.S. Appl. No. 15/428,407, filed Feb. 9, 2017, 194 pages.

Glugla, Chris Paul, "System and Method for Controlling Engine Knock of a Variable Displacement Engine," U.S. Appl. No. 15/428,433, filed Feb. 9, 2017, 194 pages.

Rollinger, John Eric, et al., "System for Deactivating Engine Cylinders," U.S. Appl. No. 15/428,465, filed Feb. 9, 2017, 195 pages.

Richards, Adam J., et al., "System and Method for Adjusting Intake Manifold Pressure," U.S. Appl. No. 15/428,539, filed Feb. 9, 2017, 193 pages.

Richards, Adam J., et al., "Active Cylinder Configuration for an Engine Including Deactivating Engine Cylinders ," U.S. Appl. No. 15/428,544, filed Feb. 9, 2017, 194 pages.

Rollinger, John Eric, et al., "System for Reactivating Deactivated Cylinders," U.S. Appl. No. 15/428,551, filed Feb. 9, 2017, 194 pages.

Doering, Jeffrey Allen, et al., "System and Method for Selecting a Cylinder Deactivation Mode," U.S. Appl. No. 15/429,807, filed Feb. 10, 2017, 193 pages.

Doering, Jeffrey Allen, et al., "System and Method for Controlling Engine Torque While Deactivating Engine Cylinders," U.S. Appl. No. 15/429,817, filed Feb. 10, 2017, 193 pages.

Rollinger, John Eric, et al., "System and Method for Controlling Busyness of Cylinder Mode Changes," U.S. Appl. No. 15/429,824, filed Feb. 10, 2017, 193 pages.

Richards, Adam J., et al., "System and Method for Intake Manifold Pressure Control," U.S. Appl. No. 15/429,834, filed Feb. 10, 2017, 193 pages.

Willard, Karen, et al., "System and Method for Operationg an Engine Oil Pump," U.S. Appl. No. 15/429,840, filed Feb. 10, 2017, 193 pages.

Rollinger, John Eric, et al., "System and Method for Mitigating Cylinder Deactivation Degradation," U.S. Appl. No. 15/429,841, filed Feb. 10, 2017, 189 pages.

Glugla, Chris Paul, "Cylinder Deactivation Control for Driveline Braking," U.S. Appl. No. 15/429,887, filed Feb. 10, 2017, 189 pages.

Glugla, Chris Paul, "System and Method for Improving Cylinder Deactivation," U.S. Appl. No. 15/429,927, filed Feb. 10, 2017, 189 pages.

Richards, Adam J., et al., "System and Method for Controlling Fuel for Reactivating Engine Cylinders," U.S. Appl. No. 15/429,889, filed Mar. 1, 2017, 194 pages.

* cited by examiner

VALVE DEACTIVATING SYSTEM FOR AN ENGINE

CROSS REFERENCE TO RELATED APPLICATION

The present application claims priority to U.S. Provisional Patent Application Ser. No. 62/347,870, filed on Jun. 9, 2016. The entire contents of the above-referenced application are hereby incorporated by reference in its entirety for all purposes.

FIELD

The present description relates to systems and methods for selectively deactivating and reactivating one or more cylinders of an internal combustion engine. The systems and methods may be applied to engines that operate poppet valves to control flow into and out of engine cylinders.

BACKGROUND AND SUMMARY

Valves of an engine cylinder may be activated and deactivated from time to time to increase vehicle fuel economy and provide a desired torque. Valve operators that activate and deactivate the valves may be designed such that they cannot overcome valve spring forces when the valves are open. Therefore, the valves may have to be deactivated and activated at precise time intervals or the valves may activate or deactivate in a different engine cycle than is desired. Further, it may be desirable to deactivate the cylinders such that exhaust gases are expelled from the cylinder before the cylinder is deactivated and fresh air is inducted into the cylinder before reactivating the cylinder. However, it may be costly and difficult to timely activate and deactivate engine cylinders so that a desired engine power or torque may be provided.

The inventor herein has recognized the above-mentioned disadvantages and has developed an engine system, comprising: a camshaft saddle including a stationary groove; and a camshaft including a discontinuous groove; the camshaft fitted to the camshaft saddle, the stationary groove aligned with the discontinuous groove.

By installing a discontinuous groove in a camshaft, it may be possible to provide the technical result of timely activating and deactivating cylinder valves with reduced cost as compared to valves that are solely activated and deactivated based on timing of operating an electrically actuated valve. In particular, since the discontinuous groove rotates synchronously with the camshaft, the discontinuous groove may provide oil flow to a deactivating valve operator without having to open a valve dedicated to operating only the one valve operator. Instead, a single electrically operated valve may control two deactivating valve operators that activate and deactivate intake and exhaust valves. Consequently, the valves may be timely activated and deactivated via a single electrically operated valve.

The present description may provide several advantages. Specifically, the approach may reduce valve train complexity. Further, the approach may reduce valve system cost. Further still, the approach may reduce computational load on a controller.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

The present description is related to systems and methods for selectively activating and deactivating cylinders and cylinder valves of an internal combustion engine. The engine may be configured and operate as discussed in the description of FIGS. 1-2D. A prophetic operating sequence for an engine that includes deactivating valves is shown in FIG. 2E. The method of FIG. 3 provides for activating and deactivating selected intake and exhaust valves of engine cylinders.

Figure 1:
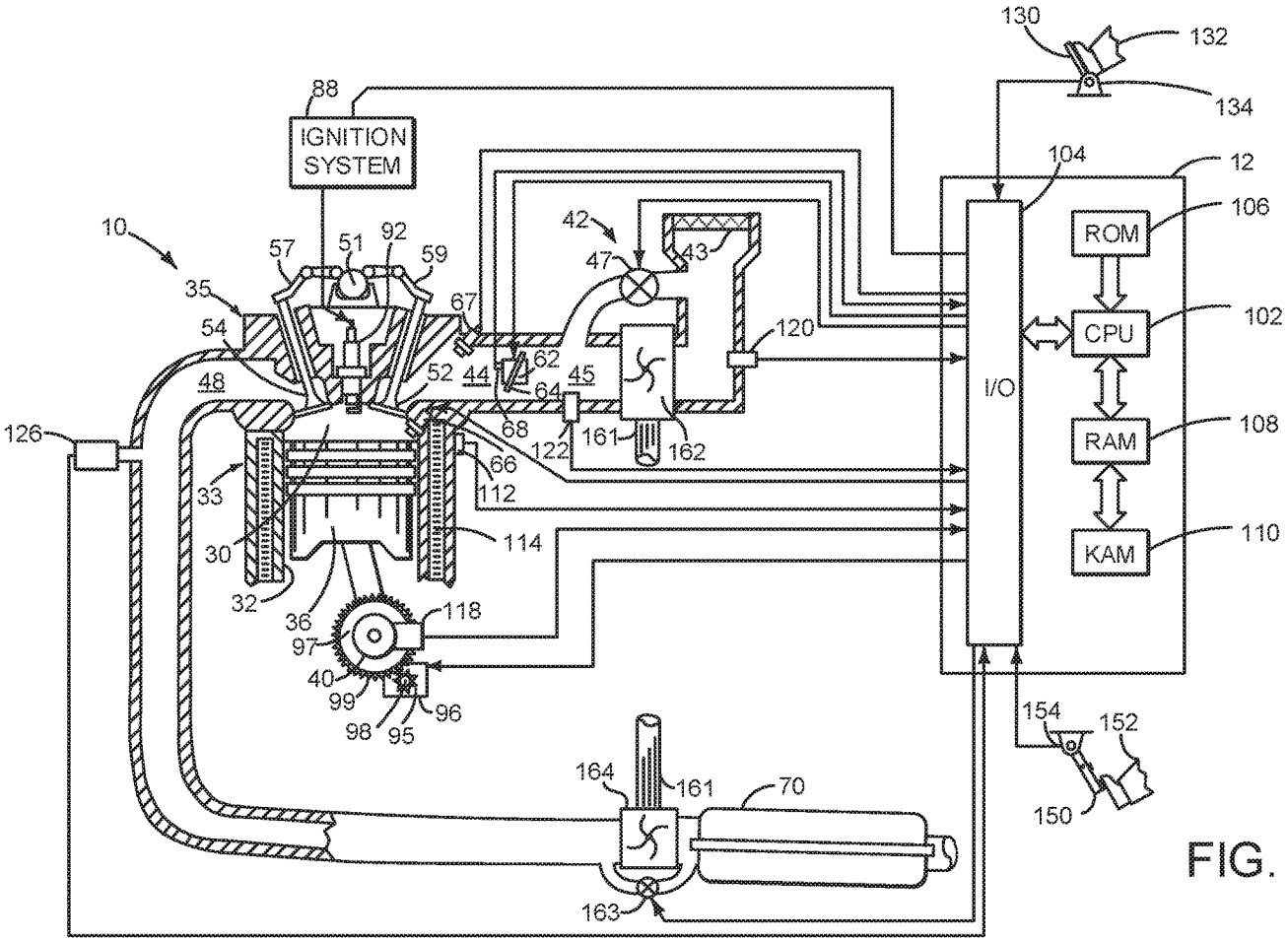
FIG. 1 is a schematic diagram of a single cylinder of an engine.

Referring to FIG. 1, internal combustion engine 10, comprising a plurality of cylinders, one cylinder of which is shown in FIG. 1, is controlled by electronic engine controller 12. Engine 10 is comprised of cylinder head casting 35 and block 33, which include combustion chamber 30 and cylinder walls 32. Piston 36 is positioned therein and reciprocates via a connection to crankshaft 40. Flywheel 97 and ring gear 99 are coupled to crankshaft 40. Starter 96 (e.g., low voltage (operated with less than 30 volts) electric machine) includes pinion shaft 98 and pinion gear 95. Pinion shaft 98 may selectively advance pinion gear 95 to engage ring gear 99. Starter 96 may be directly mounted to the front of the engine or the rear of the engine. In some examples, starter 96 may selectively supply torque to crankshaft 40 via a belt or chain. In one example, starter 96 is in a base state when not engaged to the engine crankshaft.

Combustion chamber 30 is shown communicating with intake manifold 44 and exhaust manifold 48 via respective intake valve 52 and exhaust valve 54. Each intake and exhaust valve may be operated by camshaft 51. Each intake valve 52 is in mechanical communication with camshaft 51 via intake valve operator 59. Each exhaust valve 54 is in mechanical communication with camshaft 51 via exhaust valve operator 57. Valve operators described in greater detail below may transfer mechanical energy from camshaft 51 to intake valve 52 and to exhaust valve 54. Optionally, the engine may include intake and exhaust camshafts where only the exhaust camshaft or the intake camshaft include a discontinuous groove.

Fuel injector 66 is shown positioned to inject fuel directly into cylinder 30, which is known to those skilled in the art as direct injection. Optional fuel injector 67 is shown positioned to port inject fuel to cylinder 30, which is known to those skilled in the art as port fuel injection. Fuel injectors 66 and 67 deliver liquid fuel in proportion to pulse widths from controller 12. Fuel is delivered to fuel injectors 66 and 67 by a fuel system (not shown) including a fuel tank, fuel pump, and fuel rail (not shown). In one example, a high pressure, dual stage, fuel system may be used to generate higher fuel pressures.

In addition, intake manifold 44 is shown communicating with optional turbocharger compressor 162 and engine air intake 42. In other examples, compressor 162 may be a supercharger compressor. Shaft 161 mechanically couples turbocharger turbine 164 to turbocharger compressor 162. Optional electronic throttle or central throttle 62 adjusts a position of throttle plate 64 to control air flow from compressor 162 to intake manifold 44. Pressure in boost chamber 45 may be referred to a throttle inlet pressure since the inlet of throttle 62 is within boost chamber 45. The throttle outlet is in intake manifold 44. Compressor recirculation valve 47 may be selectively adjusted to a plurality of positions between fully open and fully closed. Waste gate 163 may be adjusted via controller 12 to allow exhaust gases to selectively bypass turbine 164 to control the speed of compressor 162. Air filter 43 cleans air entering engine air intake 42.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example. Further, converter 70 may include a particulate filter.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a position sensor 154 coupled to brake pedal 150 for sensing force applied by foot 152, a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 68. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

During operation, each cylinder within engine 10 typically undergoes a four stroke cycle: the cycle includes the intake stroke, compression stroke, expansion stroke, and exhaust stroke. A cylinder cycle for a four stroke engine is two engine revolutions and an engine cycle is also two revolutions. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC).

During the compression stroke, intake valve 52 and exhaust valve 54 are closed. Piston 36 moves toward the cylinder head casting 35 so as to compress the air within combustion chamber 30. The point at which piston 36 is at the end of its stroke and closest to the cylinder head casting 35 (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion.

During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Driver demand torque may be determined via a position of accelerator pedal 130 and vehicle speed. For example, accelerator pedal position and vehicle speed may index a table that outputs a driver demand torque. The driver demand torque may represent a desired engine torque or torque at a location along a driveline that includes the engine. Engine torque may be determined from driver demand torque via adjusting the driver demand torque for gear ratios, axle ratios, and other driveline components.

Figure 2A:
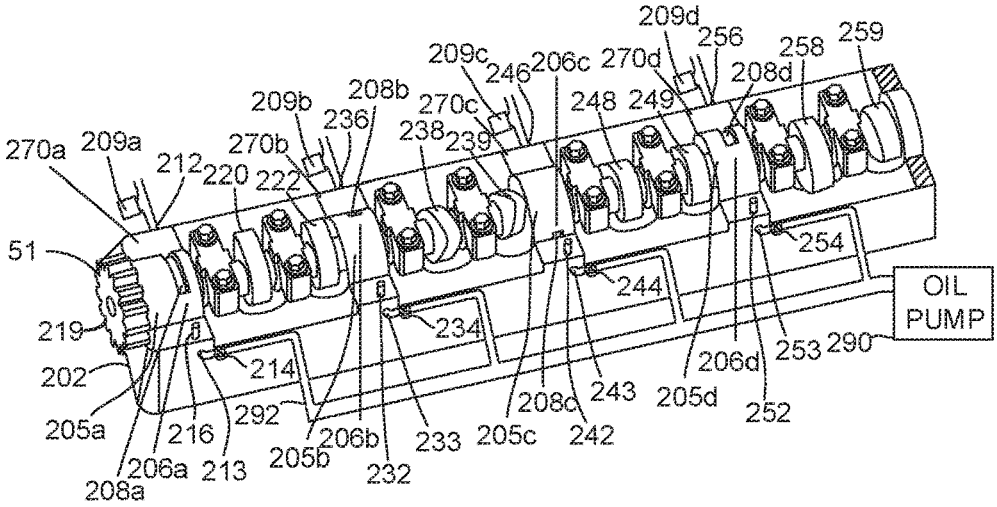
FIG. 2A shows an example camshaft for a hydraulically operated valve deactivating system.
Figure 3:
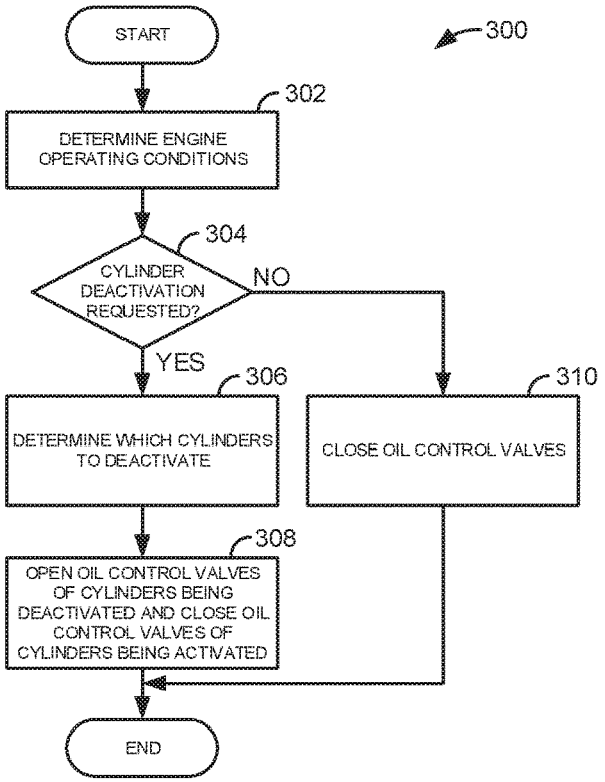
FIG. 3 is a flowchart of an example method for operating an engine with deactivating cylinders and valves.

Referring now to FIG. 2A, a camshaft for a hydraulically operated valve deactivating system is shown. Camshaft 51 may be included in the engine system shown in FIG. 1. In this example the camshaft operates valves for four cylinders, which may be all cylinders on a four cylinder engine, or one bank of a V-8 engine. Other configurations for other greater or fewer cylinder counts are possible.

In this example, camshaft 51 operates both intake and exhaust valves. In engines where separate intake and exhaust camshaft, the depicted camshaft could refer to either the intake or exhaust camshaft. The intake and exhaust valves of each engine cylinder may be individually activated and deactivated. Camshaft 51 includes sprocket 219 that allows crankshaft 40 of FIG. 1 to drive camshaft 51 via a chain. Camshaft 51 includes four journals 205*a*-205*d* (e.g., a journal for each engine cylinder on a cylinder bank), which include lands 206*a*-206*d*, and discontinuous grooves 208*a*-208*d*. Camshaft saddle 202 includes stationary grooves 210*a* (shown in FIG. 2B) for each of valve bodies 270*a*, 270*b*,

270*c*, and 270*d*. The stationary grooves 210*a* are situated to axially align with discontinuous grooves 208*a*-208*d*. Camshaft 51 also includes cam lobes. In one example, camshaft 51 may operate both intake and exhaust valves as camshaft 51 rotates. In particular, lobe 220 operates an intake valve of cylinder number one and lobe 222 operates an exhaust valve of cylinder number one. Lobe 238 operates an intake valve of cylinder number two and lobe 239 operates an exhaust valve of cylinder number two. Lobe 248 operates an intake valve of cylinder number three and lobe 249 operates an exhaust valve of cylinder number three. Lobe 258 operates an intake valve of cylinder number four and lobe 259 operates an exhaust valve of cylinder number four.

Camshaft saddle 202 includes valve bodies 270*a*, 270*b*, 270*c*, and 270*d* to support and provide oil passages leading to the camshaft discontinuous grooves. In particular, valve body 270*a* includes inlet 213, first outlet 212, and second outlet 216. First outlet 212 provides oil to exhaust valve operators via a conduit. Second outlet 216 provides oil to intake valve operators via a conduit. Valve body 270*b* includes inlet 233, first outlet 236, and second outlet 232. First outlet 236 provides oil to exhaust valve operators via a conduit. Second outlet 232 provides oil to intake valve operators via a conduit. Valve body 270*c* includes inlet 243, first outlet 246, and second outlet 242. First outlet 246 provides oil to exhaust valve operators via a conduit. Second outlet 242 provides oil to intake valve operators via a conduit. Valve body 270*d* includes inlet 253, first outlet 256, and second outlet 252. First outlet 256 provides oil to exhaust valve operators via a conduit. Second outlet 252 provides oil to intake valve operators via a conduit. Passages 216, 232, 242, and 252 supply pressurize oil from oil pump 290 to intake valve operators 249 (shown in FIG. 2C) via gallery or passage 292 for respective cylinder numbers 1-4 when control valves 214, 234, 244, and 254 are activated and open. Outlets 212, 236, 246, and 256 may supply oil pressure to exhaust valve operators 248 (shown in FIG. 2C) when control valves 214, 234, 244, and 254 are open. Discontinuous grooves 208*a*-208*d* selectively provide an oil path between inlets 213, 233, 243, and 253 and valve body outlets 212, 236, 246, and 256 that lead to exhaust valve operators. Journals 205*a*-205*d* are partially circumscribed by discontinuous grooves 208*a*-208*d*. Accumulators 209*a*-209*d* provide oil to keep exhaust valves deactivated when land 206*a* covers passage 212 for short periods of time.

Figure 2B:
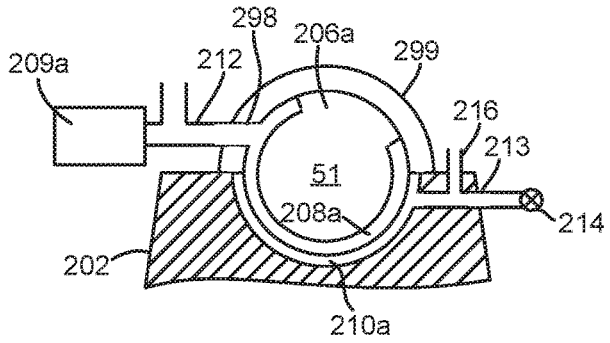
FIG. 2B shows a cross section of the camshaft and a camshaft saddle for the hydraulically operated valve deactivating system shown in FIG. 2A.

Referring now to FIG. 2B, a cross section valve body 270*a* and its associated components is shown. Each valve body of camshaft saddle 202 is constructed similarly, but lands like 206*a* are phased differently from land 206*a*. Camshaft 51 is coupled to camshaft saddle 202 via cap 299. Cap 299 covers stationary groove 210*a* formed in camshaft saddle 202, and cap 299 includes an oil outlet 298. Camshaft 51 includes discontinuous groove 208*a* that is axially aligned with stationary groove 210*a*. Valve 214 selectively allows oil to flow to intake valve operators via passage 216 and into stationary groove 210*a*. Land 206*a* selectively covers and uncovers outlet 212 which provides oil to accumulator 209*a* and exhaust valve operators as camshaft 51 rotates. Accumulator 209*a* maintains oil pressure at outlet 212 when land 206*a* is covering outlet 212.

Figure 2C:
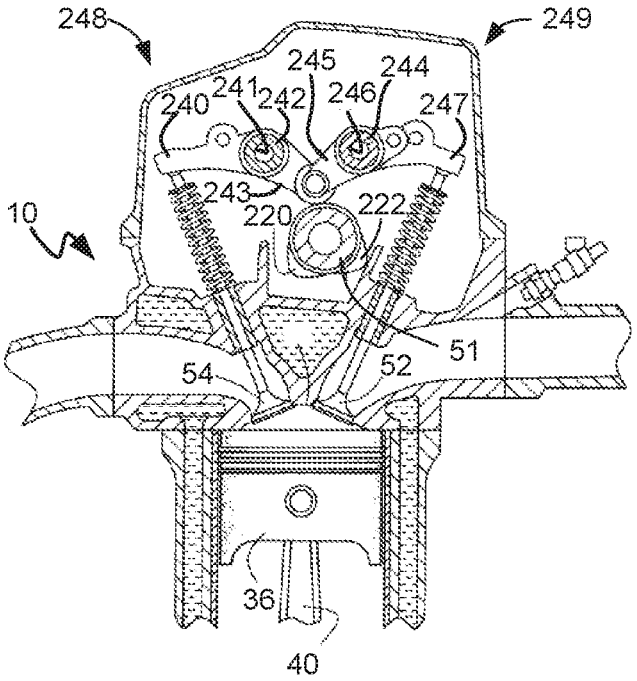
FIG. 2C shows an example valve operator for the hydraulically operated valve deactivating system shown in FIG. 2A

Referring now to FIG. 2C, example deactivating intake valve operator 59 and exhaust valve operator 57 for the hydraulically operated valve deactivating system shown in FIGS. 1 and 2A are shown. Camshaft 51 rotates so that lobe 220 selectively lifts intake follower 245, which selectively opens and closes intake valve 52. Rocker shaft 244 provides a selective mechanical linkage between intake follower 245 and intake valve contactor 247. Passage 246 allows pressurized oil to reach a piston shown in FIG. 2D so that intake valve 52 may be deactivated (e.g., remain in a closed position during an engine cycle). Intake valve 52 may be activated when oil pressure in passage 246 is low.

Similarly, camshaft 51 rotates so that lobe 222 selectively lifts exhaust follower 243, which selectively opens and closes exhaust valve 54. Rocker shaft 242 provides a selective mechanical linkage between exhaust follower 243 and exhaust valve contactor 240. Passage 241 allows pressurized oil to reach a piston shown in FIG. 2D so that exhaust valve 54 may be deactivated (e.g., remain in a closed position during an engine cycle). Exhaust valve 54 may be activated when oil pressure in passage 241 is low.

Figure 2D:
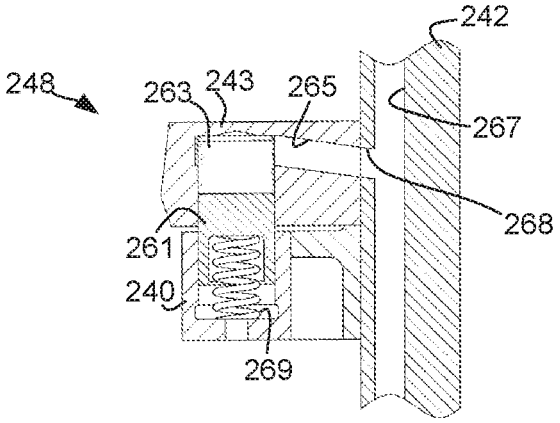
FIG. 2D shows example valve deactivating valve operators for the hydraulically operated valve deactivating system shown in FIG. 2A.
Figure 2E:
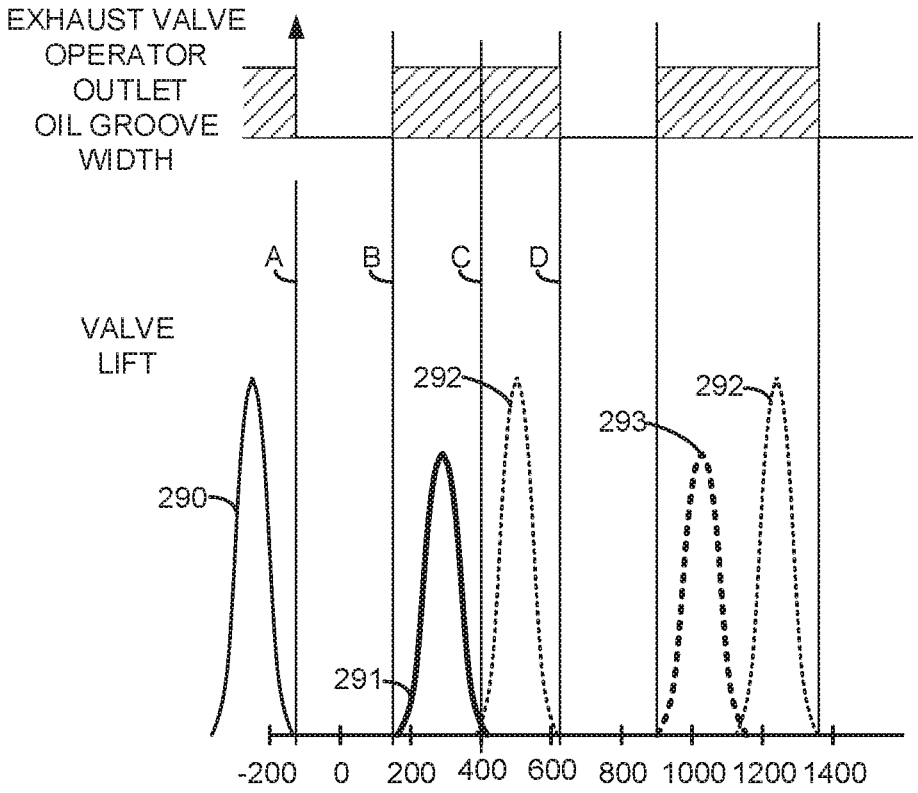
FIG. 2E is an example cylinder and valve deactivation sequence for the hydraulically operated valve deactivating system shown in FIG. 2A.

Referring now to FIG. 2D, an example exhaust valve operator 248 is shown. Intake valve operators include similar components and operate similar to the way the exhaust valve actuator operates. Therefore, for the sake of brevity, a description of intake valve operators is omitted. Exhaust follower 243 is shown with oil passage 265, which extends within camshaft follower 264. Oil passage 265 fluidly communicates with port 268 in rocker shaft 242. Piston 263 and latching pin 261 selectively lock follower 243 to exhaust valve contactor 240, which causes exhaust valve contactor 240 to move in response to the motion of follower 243 when oil is not acting on piston 263. The exhaust valve operator 248 is in an activated state during such conditions.

Piston 263 may be acted upon by oil pressure within oil passages 267 and 265. Piston 263 is forced from its at-rest position shown in FIG. 2C (e.g., its normally activated state) by high pressure oil in passage 265 acting against force of spring 269 to its deactivated state. Spring 269 biases piston 263 into a normally locked position that allows exhaust valve contactor 240 to operate an exhaust valve 54 when oil pressure in passage 565 is low.

Latching pin 261 stops at a position (e.g., unlocked position) where follower 243 is no longer locked to exhaust valve contactor 240, thereby deactivating exhaust valve 54 when normally locked latching pin 261 is fully displaced by high pressure oil operating on piston 263. Camshaft follower 243 is rocked according to the movement of cam lobe 222 when exhaust valve operator 248 is in a deactivated state. Exhaust valve 54 and exhaust valve contactor 240 remain stationary when piston latching pin 261 is in its unlocked positon.

Thus, oil pressure may be used to selectively activate and deactivate intake and exhaust valves via intake and exhaust valve operators. Specifically, intake and exhaust valves may be deactivated by allowing oil to flow to the intake and exhaust valve operators. It should be noted that intake and exhaust valve operators may be activated and deactivated via the mechanism shown in FIG. 2D. FIGS. 2C and 2D depict rocker shaft mounted deactivating valve actuators. Other types of deactivating valve actuators are possible and compatible with the invention including deactivating roller finger followers, deactivating lifters, or deactivating lash adjusters.

Referring now to FIG. 2E, a valve and cylinder deactivation sequence for the mechanism of FIGS. 2A-2D is shown. The valve deactivation sequence may be provided by the system of FIGS. 1-2D.

The first plot from the top of FIG. 2E is a plot of exhaust cam groove width at the passage leading to the exhaust valve operator versus crankshaft angle. The vertical axis represents exhaust camshaft groove width and groove width increases in the direction of the vertical axis arrow. The horizontal axis represents engine crankshaft angle, where zero is top-dead-center compression stroke for the cylinder whose intake and exhaust grooves are shown. In this example, the exhaust groove corresponds to the width of groove 208*a* of FIG. 2A measured at the oil outlet passage 212. The crankshaft angles for the exhaust groove width are the same as the crankshaft angle in the second plot from the top of FIG. 2E.

The second plot from the top of FIG. 2E is a plot of intake and exhaust valve lift versus engine crankshaft angle. The vertical axis represents valve lift and valve lift increases in the direction of the vertical axis arrow. The horizontal axis represents engine crankshaft angle and the two plots are aligned according to crankshaft angle. Thin solid line 290 represents intake valve lift for cylinder number one when its intake valve operator is activated. Thick solid line 291 represents exhaust valve lift for cylinder number one when its exhaust valve operator is activated. Thin dashed lines 292 represent intake valve lift for cylinder number one if its intake valve operator were activated. Thick dashed line 293 represents exhaust valve lift for cylinder number one if its exhaust valve operator were activated. Vertical lines A-D represent crankshaft angles of interest for the sequence.

The intake valve lift for cylinder number one is shown increasing and then decreasing before crankshaft angle A. An oil control valve, such as 214 of FIG. 2A, is closed before crankshaft angle A to prevent intake and exhaust valve deactivation. The intake valve lift 290 is shown increasing during cylinder number one's intake stroke before crankshaft angle A. Pressurized oil sufficient to deactivate intake valves is not present in oil passage 216 before crankshaft angle A.

At crankshaft angle A, the oil control valve (e.g., 214 of FIG. 2A) may be opened to deactivate intake and exhaust valves. The stationary groove (e.g., 208*a* of FIG. 2B) and passage 216 are pressurized with oil after the oil control valve is opened so that the intake valve operator latching pin may be displaced while the outlet 298 is covered via land 206*a*. Thus, outlet passage 298 is not pressurized with oil at angle A because the land 206*a* (shown in FIG. 2A) covers the valve body outlet 298. Therefore, only the intake valve begins to be deactivated at crankshaft angle A. The intake valve operator latching pin is disengaged from its normal position before crankshaft angle C to prevent the intake valve from opening.

At crankshaft angle B, the land of the exhaust camshaft land 206*a* for cylinder number one makes way for the discontinuous groove 208*a*, which allows oil to reach the outlet 298 and exhaust valve operator for cylinder number one. Oil can flow to the intake valve operator and the exhaust valve operator at crankshaft angle B, but since the exhaust valve is partially lifted at crankshaft angle B, the exhaust valve operates until the exhaust valve closes near crankshaft angle C. The exhaust valve operator latching pin is disengaged from its normally engaged position before crankshaft angle D to prevent the exhaust valve from opening.

At crankshaft angle C, the intake valve does not open since the intake valve operator is deactivated for the engine cycle. Further, the exhaust valve operator latching pin is disengaged from its normal position before crankshaft angle D to prevent the exhaust valve from opening. Consequently, the exhaust valve does not open for the cylinder cycle. The intake and exhaust valves may remain deactivated until the intake and exhaust operators are reactivated by reducing oil pressure to the intake and exhaust valve operators.

The intake and exhaust valve may be reactivated via deactivating the oil control valve 214 and allowing oil pressure in the intake and exhaust valve operators to be reduced or via dumping oil pressure from the intake and exhaust valve operators via a dump valve (not shown).

Oil accumulator 209*a* maintains oil pressure in oil passage 212 during the portion of the cycle after crankshaft angle D when the exhaust cam groove land blocks passage 298. The accumulator 209*a* compensates for oil leakage through various clearances during the time when oil supply from the pump is interrupted. The oil accumulator 209*a* may include a dedicated piston and spring or may be combined with the latch pin mechanism such as the mechanism depicted in FIG. 2D. The inputs and outputs for the valve bodies described in FIGS. 2A-2D may also be referred to as ports.

Thus, the system of FIGS. 1-2C provides for an engine system, comprising: a camshaft saddle including a stationary groove; and a camshaft including a discontinuous groove; the camshaft fitted to the camshaft saddle, the stationary groove aligned with the discontinuous groove. The engine system includes where the discontinuous groove is oriented axially along the camshaft. The engine system further comprises an oil inlet port in fluidic communication with the stationary groove. The engine system includes where the oil inlet port is located along the camshaft saddle. The engine system further comprises an oil pump supplying oil to the oil inlet port. The engine system further comprises an oil control valve, the oil control valve located along an oil gallery leading from the oil pump to the oil inlet port. The engine system further comprises an oil outlet port located along the camshaft saddle. The engine system includes where the oil outlet port is in fluidic communication with an intake valve operator.

The system of FIGS. 1-2C also provides for an engine system, comprising: a camshaft including a first discontinuous groove, and a second discontinuous groove; a first valve body including a first stationary groove and a first inlet port and a first outlet port; a first intake valve operator in mechanical communication with the camshaft and in fluidic communication with the first discontinuous groove; a second valve body including a second stationary groove and a second inlet port and a second outlet port; and a second intake valve operator in mechanical communication with the camshaft and in fluidic communication with the second discontinuous groove. The engine system further comprises a first valve positioned along a conduit between the first valve body and an oil pump, a second valve positioned along the conduit between the second valve body and the oil pump. The engine system further comprises a controller including executable instructions stored in non-transitory memory, which when executed by the controller, open the first valve independent from opening the second valve. The engine system further comprises additional instructions to open the second valve at a same time the first valve is opened. The engine system further comprises a first exhaust valve operator in mechanical communication with the camshaft and in fluidic communication with the first stationary groove. The engine system includes where the first discontinuous groove is positioned to inhibit oil flow to an exhaust valve operator between exhaust valve closing of a cylinder and intake valve opening of the cylinder.

The system of FIGS. 1-2C also provides for a vehicle system, comprising: an engine including a camshaft with a discontinuous groove; a valve operator in mechanical communication with an exhaust valve and in fluidic communication with the discontinuous groove; and a camshaft journal cap. The vehicle system includes where the journal cap includes an oil exit port. The vehicle system further comprises an accumulator in fluidic communication with the oil exit port. The vehicle system includes where the oil exit port is in fluidic communication with an exhaust valve operator. The vehicle system includes where the discontinuous groove is circumferential. The vehicle system includes where the discontinuous groove is axially oriented on the camshaft.

Referring now to FIG. 3, a method for operating an engine with deactivating cylinders and valves is shown. The method of FIG. 3 may be included in the system described in FIGS. 1-2C. The method may be included as executable instructions stored in non-transitory memory. The method of FIG. 3 may perform in cooperation with system hardware and other methods described herein to transform an operating state of an engine or its components.

At 302, method 300 determines engine operating conditions. Engine operating conditions may include but are not limited to engine speed, engine torque, requested engine torque, barometric pressure, engine temperature, and ambient temperature. Method 300 proceeds to 304 after determining engine operating conditions.

At 304, method 300 judges if cylinder deactivation is requested. In one example, cylinder deactivation may be requested based on engine speed, requested engine torque, and engine temperature. If engine operating conditions for deactivating engine cylinders are present, the answer is yes and method 300 proceeds to 306. Otherwise, the answer is no and method 300 proceeds to 310.

At 310, method 300 closes all oil control valves for deactivating cylinders. Deactivating the oil control valves ceases oil flow from the engine oil pump to intake and exhaust valve deactivating operators. If an oil control valve was previously opened, it may be closed at a specific time to align near angle A of FIG. 2E to ensure that a cylinder's intake valve starts lifting before the cylinder's exhaust valve. Consequently, oil pressure in oil galleries leading to the intake and exhaust valve operators decreases and all engine intake and exhaust valves are activated. Method 300 proceeds to exit.

At 306, method 300 determines which engine cylinders to deactivate. In on example, a map of cylinders to deactivate is indexed by engine speed and requested engine torque. The map or table stored in controller memory outputs which engine cylinders are to be deactivated. Method 300 proceeds to 308.

At 308, method 300 opens oil control valves to supply oil to the cylinder to be deactivated as determined at 306. The method closes the oil control valves related to cylinders that will not be deactivated. The timing of opening and closing oil control valves for each cylinder may occur at specific times to align near angle A of FIG. 2E to ensure that the intake valve changes state before the exhaust valve. The actual total number of cylinders deactivated may vary between engine operating conditions. For example, if the engine is a four cylinder engine with a firing order of 1-3-4-2, cylinders 1 and 4 may be deactivated during one engine cycle and cylinders 3 and 2 may be deactivated during a different engine cycle. Method 300 proceeds to exit after opening the oil control valves.

In this way, cylinder valves of an engine may be activated and deactivated. Further, the number of cylinders and the pattern of cylinders deactivated may vary from engine cycle to engine cycle.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, at least a portion of the described actions, operations and/or functions may graphically represent code to be programmed into non-transitory memory of the computer readable storage medium in the control system. The control actions may also transform the operating state of one or more sensors or actuators in the physical world when the described actions are carried out by executing the instructions in a system including the various engine hardware components in combination with one or more controllers.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. An engine system, comprising:

a camshaft saddle including a stationary groove;

a camshaft including a discontinuous groove, the camshaft fitted to the camshaft saddle, and the stationary groove aligned with the discontinuous groove;

an oil pump supplying oil to an oil inlet port wherein the oil inlet port is located along the camshaft saddle and in fluidic communication with the stationary groove; and an oil control valve located along an oil gallery leading from the oil pump to the oil inlet port.

2. The engine system of claim 1, where the discontinuous groove is oriented axially along the camshaft.

3. The engine system of claim 1, further comprising an oil outlet port located along the camshaft saddle.

4. The engine system of claim 1, where an oil outlet port is in fluidic communication with an intake valve operator.

5. An engine system, comprising:

a camshaft including a first discontinuous groove, and a second discontinuous groove;

a first valve body including a first stationary groove and a first inlet port and a first outlet port;

a first intake valve operator in mechanical communication with the camshaft and in fluidic communication with the first discontinuous groove;

a first valve positioned along a conduit between the first valve body and an oil pump, a second valve positioned along the conduit between a second valve body and the oil pump, the second valve body including a second stationary groove and a second inlet port and a second outlet port; and a second intake valve operator in mechanical communication with the camshaft and in fluidic communication with the second discontinuous groove.

6. The engine system of claim 5, further comprising a controller including executable instructions stored in non-transitory memory, which when executed by the controller, open the first valve independent from opening the second valve.

7. The engine system of claim 6, further comprising additional instructions to open the second valve at a same time the first valve is opened.

8. The engine system of claim 5, further comprising a first exhaust valve operator in mechanical communication with the camshaft and in fluidic communication with the first stationary groove.

9. The engine system of claim 5, where the first discontinuous groove is positioned to inhibit oil flow to an exhaust valve operator between exhaust valve closing of a cylinder and intake valve opening of the cylinder.

10. A vehicle system, comprising:

an engine including a camshaft with a discontinuous groove;

a valve operator in mechanical communication with an exhaust valve and in fluidic communication with the discontinuous groove; and a camshaft journal cap including an oil exit port; and an accumulator in fluidic communication with the oil exit port.

11. The vehicle system of claim 10, where the oil exit port is in fluidic communication with an exhaust valve operator.

12. The vehicle system of claim 10, where the discontinuous groove is circumferential.

13. The vehicle system of claim 10, where the discontinuous groove is axially oriented on the camshaft.

* * * * *